United States Patent [19]

Brindley et al.

[11] 4,429,214

[45] Jan. 31, 1984

[54] ELECTRICAL HEATING PANEL

[75] Inventors: Robert J. Brindley, Tonawanda; Salvatore R. Taravella, Buffalo; Robert M. Dean, North Tonawanda, all of N.Y.

[73] Assignee: National Gypsum Company, Dallas, Tex.

[21] Appl. No.: 424,115

[22] Filed: Sep. 27, 1982

[51] Int. Cl.[3] ..... H05B 3/18; H05B 3/28

[52] U.S. Cl. ..... 219/345; 219/213; 219/549; 338/283

[58] Field of Search ..... 219/345, 350, 351, 353, 219/354, 355, 357, 342, 213, 528, 543, 548, 549; 338/210, 280, 281, 283, 306, 314

[56] References Cited

U.S. PATENT DOCUMENTS

| | | | |
|---|---|---|---|
| 2,619,850 | 11/1952 | Poutiere | 219/549 |
| 3,095,491 | 6/1963 | Deacon | 219/19 |
| 3,550,267 | 12/1970 | Williams | 29/611 |
| 3,598,960 | 8/1971 | Deacon | 219/213 |
| 3,686,472 | 8/1972 | Harris | 219/345 |
| 4,160,897 | 7/1979 | Makino | 219/543 |
| 4,386,260 | 5/1983 | Zellers | 219/345 |
| 4,387,293 | 7/1983 | Grice et al. | 219/549 |

FOREIGN PATENT DOCUMENTS

| | | | |
|---|---|---|---|
| 218644 | 5/1961 | Austria | 219/345 |
| 458262 | 3/1928 | Fed. Rep. of Germany | 219/345 |
| 916678 | 8/1946 | France | 219/342 |
| 184240 | 7/1922 | United Kingdom | 219/345 |

*Primary Examiner*—Roy N. Envall, Jr.
*Assistant Examiner*—Geoffrey S. Evans
*Attorney, Agent, or Firm*—Robert F. Hause

[57] ABSTRACT

A gypsum wallboard with electrical heating wire disposed in grooves arranged to minimize tendencies for the board to crack when lifted by the two opposite board ends.

8 Claims, 2 Drawing Figures

ELECTRICAL HEATING PANEL

This invention relates to an electric radiant heating panel formed by making grooves in the back face of a gypsum wallboard, inserting a heating wire, and refilling the groove. In particular, the invention is directed to the arrangement of the grooves to minimize the creation of lines of weakness extending across the board, particularly at the end remote from the lead-in wires.

Gypsum wallboards have been commercially modified into electric radiant heating panels in substantial quantities, with a wire groove pattern quite similar to that disclosed in U.S. Pat. No. 3,095,491. One significant difference has been that, commercially, the boards are made with a much greater distance between the wires and the remote end of the board, remote from the non-heating lead wires, than what is shown in U.S. Pat. No. 3,095,491. A second difference has been in the location of the lead wires, in that, commercially, the lead wires have been connected to heating wire at the end of one of the narrow serpentine loops so that the continuous cross-cut groove near the end of the board at the lead-in end has only heating wire in it, extending continuously across the board.

The greater distance between the wires and the remote end of the board has been a significant difference in that it places the crosswise line of cross-cuts at the remote ends of the serpentine loops further from the end of the board, whereat the board is held when being picked up and carried by workmen. These cross-cuts at the remote end of the serpentine loops create a line of weakness, whereby the boards sometimes break or crack along this line, when being carried by workmen, one at each end, particularly when the line of weakness is spaced a considerable distance from the end.

The present invention provides serpentine loops which alternately are longer and shorter than the standard extent of the loops, particularly at the remote end from the lead-in, and, alternatively, also at the lead-in end. In a preferred form of the invention the continuous cut across the lead-in end of the board is also replaced with serpentine loop ends alternately longer and shorter than an average extent of the loops, to improve the resistance to cracking at this end of the board, also.

It is an object of the present invention to provide an improved heating panel of gypsum wallboard with electrical heating wire disposed in serpentine grooves, cut into the wallboard back face.

It is a further object to provide such a wallboard with a markedly improved resistance to cracking when being lifted, carried and installed.

These and other objects and advantages of the invention will be more readily apparent when considered in relation to the preferred embodiments as set forth in the specification and shown in the drawings in which.

Figure 1:
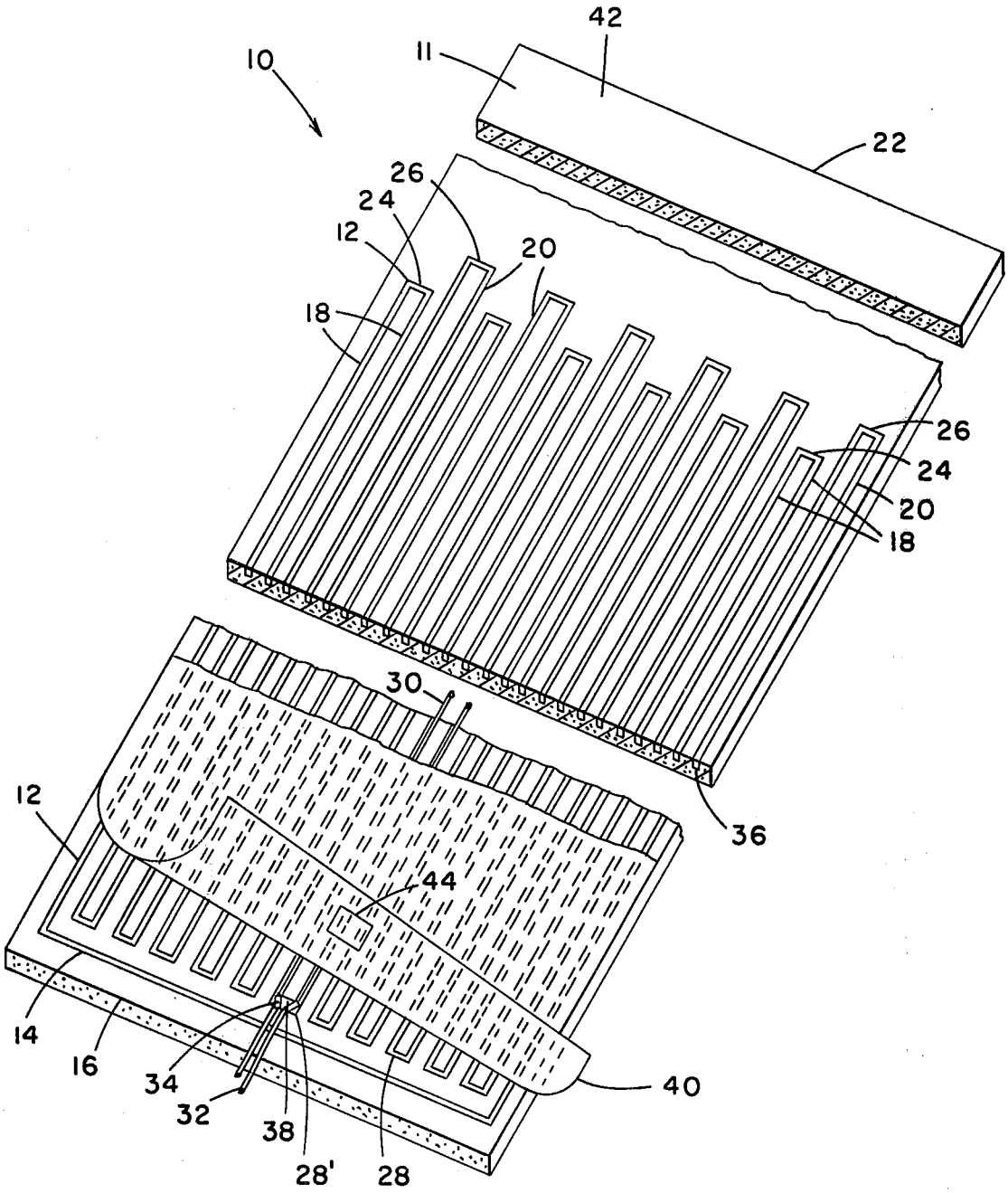
FIG. 1 is a perspective view of a radiant heating panel according to the present invention and having a covering sheet partly withdrawn.

Referring to FIG. 1, there is shown a sheet of fire-resistant, paper-covered, gypsum wallboard 10, of a generally elongated, rectangular configuration. The back face 11 of wallboard 10, which will be the upper face when the board is mounted, as a ceiling board, has a serpentine continuous recess 12 provided therein.

Recess 12 includes a single straight lateral portion 14 extending across the lead-in end 16 of board 10 and twenty-four straight longitudinal portions 18 and 20 at substantially uniformly spaced locations, averaging just less than two inches apart, across the four-foot width of the board 10. The length of board 10 is twelve feet; however the length may also be any distance from about six feet to about twelve feet. The advantages provided by the invention are of progressively greater significance, the longer the board is.

The advantages of the invention are also most effective in a board which is formed leaving about three feet of the length, at the remote end 22 opposite the lead-in end 16, free of any recesses. The twenty-four straight portions 18 and 20 have an average length of about nine feet. Straight portions 18 have a length of eight feet and eleven inches. Straight portions 20 have a length of nine feet and one inch. Straight portions 18 are arranged in pairs, each pair having a short lateral recess portion 24 adjoining the two ends nearest remote end 22. Disposed in an alternating arrangement between each two pairs of straighter portions 18, are a pair of straight portions 20 and a short lateral recess portion 26 adjoining the two ends of each two straight portions 20, nearest remote end 22.

A short lateral recess portion 28 adjoins each pair of straight portions 18 to an adjacent pair of straight portions 20, on each side thereof, nearest the lead-in 16.

The lateral portion 28' nearest the center of the board, laterally, is formed substantially larger than the other lateral portions 28, for reasons to be discussed further below.

An electrical heating wire 30 which may be of a nichrome resistance wire, having a resistance sufficient to produce about 2.5 watts per foot of wire, extends completely throughout the bottom recess 12, including its portions 14, 18, 20, 24, 26 and 28, with its two ends disposed at center lateral portion 28'.

The two opposite ends of heating wire 30 are soldered to the two ends of a pair of non-heating wire leads 32, 32. Heating wire 30 and non-heating wire leads 32, 32 are both covered with insulation throughout except at the soldered joints, which are covered with short flexible insulating plastic tubes 34.

A filling of a material such as plaster 36 is placed within all of recess 12 except lateral portion 28'. The short lateral recess portion 28' is larger than the rest of recess 12 so that the two soldered joints, with their protective plastic tubes 34, can all be disposed therein.

A material which is stronger than plaster 36, such as epoxy 38, surrounds the plastic tubes 34, filling lateral portion 28'. The plaster 36 and epoxy 38 are disposed within and completely filling recess 12, and flush with the back face 11 of wallboard 10, and, upon hardening, function to retain wire 30, and the soldered joints with their plastic tubes 34, within the recess 12.

A separate paper sheet 40, preferably similar to paper 42 which forms wallboard back face 11, is disposed over, and adhered to, the paper 42 and the plaster 36 and epoxy 38, throughout the wallboard back face 11, except for a small hole 44 over lateral recess portion 28', whereat the non-heating lead extends outward from recess portion 28'.

Figure 2:
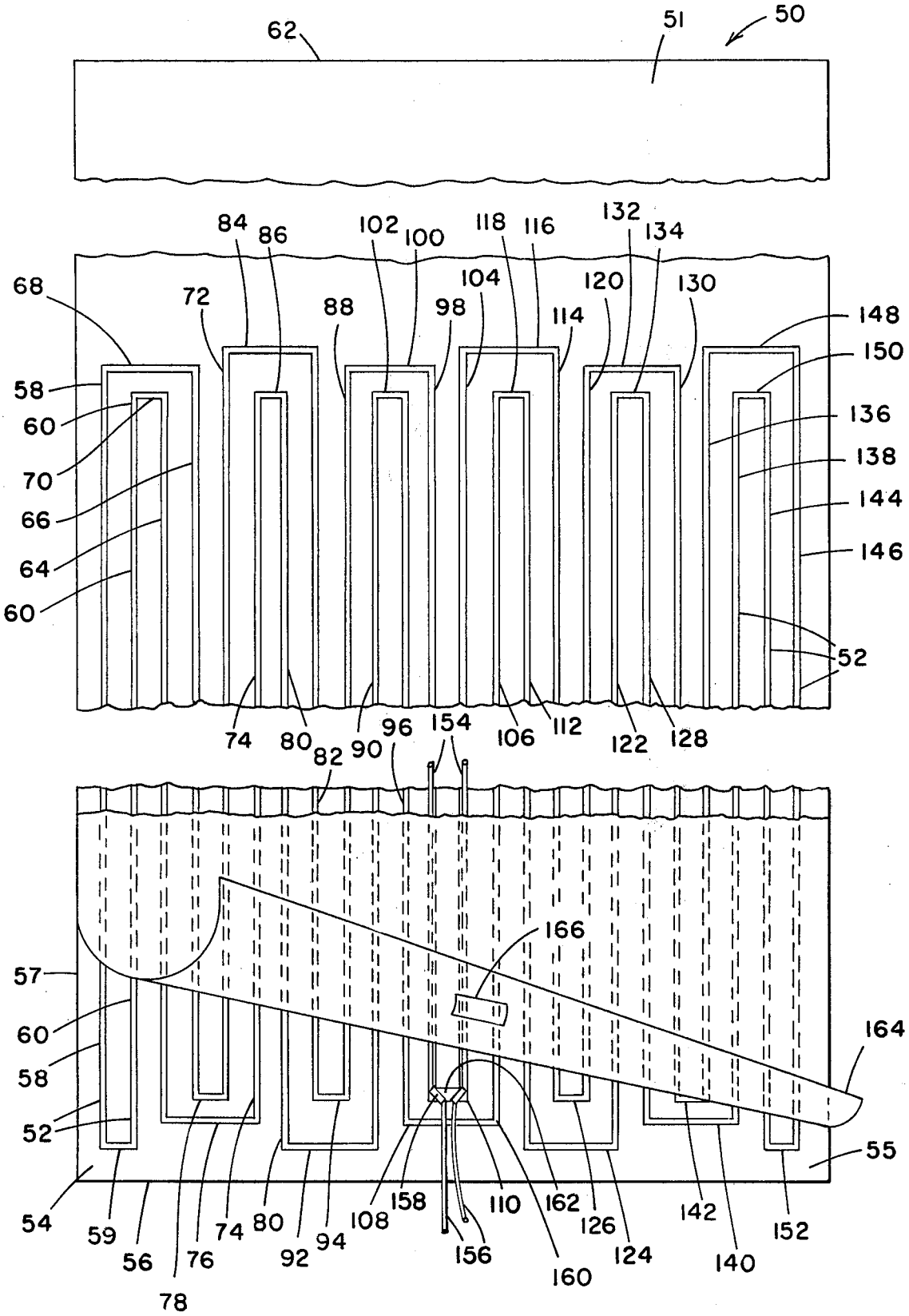
FIG. 2 is a face view of a modified form of the invention, with the covering sheet cut away in part.

Referring to FIG. 2, a modified form of wallboard 50 is shown, having a back face 51 in which twin serpentine recesses 52 are provided, with a different arrangement from the recess 12 of the wallboard 10 of FIG. 1. Recesses 52 do not include any laterally extending portions with a length greater than about one-eighth of the width of the wallboard 50.

The twin recesses 52 follow two generally parallel, spaced serpentine paths from one corner 54, at the lead-in end 56, to the opposite corner 55, at the lead-in end 56. At the lead-in end corner 54, two parallel straight longitudinal portions 58 and 60 extend from about two inches in from lead-in end 56 to at least over halfway to the remote end 62 of wallboard 50. Portion 58 extends to about two inches closer to remote end 62 than does portion 60. Portion 58 is about two inches from a board side edge 57. Portion 58 is adjoined to adjacent portion 60 at the lead-in end 56 by a lateral recess portion 59. Portions 58 and 60 are a little less than two inches apart.

Laterally inward of portions 58 and 60 are two parallel straight longitudinal portions 64 and 66. The remote end of portion 66 is the same distance from remote end 62 as portion 58 and these two recess remote ends are joined by lateral recess portion 68. The remote end of portion 64 is the same distance from remote end 62 as portion 60 and these two recess remote ends are joined by lateral recess portion 70.

Portion 64 extends to about three inches from wallboard lead-in end 56 and portion 66 extends to about five inches from lead-in end 56.

Laterally inward of portions 64 and 66 are two parallel straight longitudinal portions 72 and 74. The lead-in end of portion 74 is the same distance from wallboard lead-in end 56 as portion 64 and these two recess lead-in ends are joined by lateral recess portion 76. The lead-in end of portion 72 is the same distance from wallboard lead-in end 56 as portion 66 and these two recess lead-in ends are joined by lateral recess portion 78.

Portion 72 extends to about one inch closer to wallboard remote end 62 than does portion 66, and portion 74 extends to the same distance from remote end 62 as does portion 64.

Laterally inward of portions 72 and 74 are two parallel straight longitudinal portions 80 and 82. The remote end of portion 82 is the same distance from wallboard remote end 62 as portion 72 and these two recess remote ends are joined by lateral recess portion 84. The remote end of portion 80 is the same distance from wallboard remote end 62 as portion 74 and these two recess remote ends are joined by lateral recess portion 86.

Portion 80 extends to about two inches from wallboard lead-in end 56 and portion 82 extends to about five inches from lead-in end 56.

Laterally inward of portions 80 and 82 are two parallel straight longitudinal portions 88 and 90. The lead-in end of portion 90 is the same distance from wallboard lead-in end 56 as portion 80 and these two recess lead-in ends are joined by lateral recess portion 92. The lead-in end of portion 88 is the same distance from wallboard lead-in end 56 as portion 82 and these two recess lead-in ends are joined by lateral recess portion 94.

Portion 88 extends to about one inch farther from wallboard remote end 62 than does portion 82, and portion 90 extends to the same distance from remote end 62 as does portion 80.

Laterally inward of portions 88 and 90 are two parallel straight longitudinal portions 96 and 98. The remote end of portion 98 is the same distance from wallboard remote end 62 as portion 88 and these two recess remote ends are joined by lateral recess portion 100. The remote end of portion 96 is the same distance from wallboard remote end 62 as portion 90 and these two recess remote ends are joined by lateral recess portion 102.

Portion 96 extends to about three inches from wallboard lead-in end 56 and portion 98 extends to about five inches from lead-in end 56.

Progressing onward laterally across the wallboard, there are two parallel straight longitudinal portions 104 and 106. The lead-in end of portion 106 is the same distance from wallboard lead-in end 56 as portion 96 and these two recess lead-in ends are joined by lateral recess portion 108. The lead-in end of portion 104 is the same distance from wallboard lead-in end 56 as portion 98 and these two recess lead-in ends are joined by a lateral recess portion 110 which is formed substantially larger than other portions of recess 52, for reasons to be discussed further below.

Portion 104 extends to about one inch closer to wallboard remote end 62 than does portion 98, and portion 106 extends to the same distance from remote end 62 as does portion 96.

Progressing further across the wallboard, there are two parallel straight longitudinal portions 112 and 114. The remote end of portion 114 is the same distance from wallboard remote end 62 as portion 104 and these two recess remote ends are joined by lateral recess portion 116. The remote end of portion 112 is the same distance from wallboard remote end 62 as portion 106 and these two recess remote ends are joined by lateral recess portion 118.

Portion 112 extends to about two inches from wallboard lead-in end 56 and portion 114 extends to about five inches from lead-in end 56.

Progressing further across the wallboard, there are two parallel straight longitudinal portions 120 and 122. The lead-in end of portion 122 is the same distance from wallboard lead-in end 56 as portion 112 and these two recess lead-in ends are joined by lateral recess portion 124. The lead-in end of portion 120 is the same distance from wallboard lead-in end 56 as portion 114 and these two recess lead-in ends are joined by lateral recess portion 126.

Portion 120 extends to about one inch farther from wallboard remote end 62 than does portion 114 and portion 122 extends to the same distance from remote end 62 as does portion 112.

Progressing further across the wallboard, there are two parallel straight longitudinal portions 128 and 130. The remote end of portion 130 is the same distance from wallboard remote end 62 as portion 120 and these two recess remote ends are joined by lateral recess portion 132. The remote end of portion 128 is the same distance from wallboard remote end 62 as portion 122 and these two recess remote ends are joined by lateral recess portion 134.

Portion 128 extends to about three inches from wallboard lead-in end 56 and portion 130 extends to about five inches from lead-in end 56.

Progressing further across the wallboard, there are two parallel straight longitudinal portions 136 and 138. The lead-in end of portion 138 is the same distance from wallboard lead-in end 56 as portion 128 and these two recess lead-in ends are joined by lateral recess portion 140. The lead-in end of portion 136 is the same distance from wallboard lead-in end 56 as portion 130 and these two recess lead-in ends are joined by lateral recess portion 142.

Portion 136 extends to about one inch closer to wallboard remote end 62 than does portion 130, and portion 138 extends to the same distance from remote end 62 as does portion 128.

Progressing further across the wallboard, there are the last two parallel straight longitudinal portions 144 and 146. The remote end of portion 146 is the same distance from wallboard remote end 62 as portion 136 and these two recess remote ends are joined by lateral recess portion 148. The remote end of portion 144 is the same distance from wallboard remote end 62 as portion 138 and these two recess remote ends are joined by lateral recess portion 150.

Portions 144 and 146 extend to about two inches from wallboard lead-in end 56 and these two recess lead-in ends are joined by lateral recess portion 152.

An electrical heating wire 154 extends completely throughout the bottom of the recesses 52, including its portions 58, 59, 60, 64, 66, 68, 70, 72, 74, 76, 78, 80, 82, 84, 86, 88, 90, 92, 94, 96, 98, 100, 102, 104, 106, 108, 110, 112, 114, 116, 118, 120, 122, 124, 126, 128, 130, 132, 134, 136, 138, 140, 142, 144, 146, 148, 150 and 152, with its two ends disposed in lateral recess portion 110.

The two opposite ends of heating wire 154 are soldered to the two ends of a pair of non-heating wire leads 156, 156. Heating wire 154 and non-heating wire leads 156, 156 are both covered with insulation throughout except at the soldered joints, which are covered with short flexible insulating plastic tubes 158.

A filling of a material such as plaster 160 is placed within all recesses except lateral portion 110. The short lateral recess portion 110 is larger than the rest of recess 52 so that the two soldered joonts, with their protective plastic tubes 158, can all be disposed therein.

A material stronger than plaster, such as epoxy 162, surrounds the plastic tubes 158, filling lateral portion 110.

A paper sheet 164 is disposed over and adhered to the back side 51 and the plaster 160 and epoxy 162, except for a small hole 166 over lateral portion 110, whereat the non-heating wire lead extends outward from lateral recess portion 110.

The pattern of the recesses in the embodiments of FIG. 1 and FIG. 2 will be seen to provide staggering in the location of end lateral recesses of the respective serpentine patterns, the most important place being at the board end opposite to the lead-in end, when the wiring pattern does not extend to but about one-half to three-quarters of the way from the lead-in end to the remote end of the wallboard. This staggering of the location of end lateral recesses provides a markedly increased strength in the board, in resistance to inadvertent cracking when being carried or mounted on ceiling joists.

Having completed a detailed disclosure of the preferred embodiments of our invention, so that others may practice the same, we contemplate that variations may be made without departing from the essence of the invention.

We claim:

1. In an electrical radiant heating panel comprising a sheet of gypsum wallboard having a serpentine recess provided in and extending along one face thereof, an electrical resistance heating wire positioned in and extending lengthwise of said recess, non-heating lead wires for connection to a source of electrical current having a portion within said recess each connected to an opposite end of said heating wire and extending from said recess, filler material filling said recesses over said wire, and a paper sheet covering said wallboard face and said filling, the improvement wherein said serpentine recess comprises a plurality of elongate parallel longitudinal portions and connecting short lateral portions with a substantial portion of the connecting short lateral portions at least one end arranged in a staggered, non-aligned form, whereby the wallboard is made highly resistant to inadvertent cracking when lifted by the board ends.

2. An electrical radiant heating panel as defined in claim 1 wherein said serpentine recess is disposed relatively close to one end of said wallboard and is spaced relatively far from the opposite end and said staggered lateral portions are nearer said opposite end.

3. An electrical radiant heating panel as defined in claim 1 wherein said recess includes a long lateral portion extending across one end of said wallboard connected to a single serpentine recess extending over halfway toward a remote end of said wallboard, the connecting short lateral portions of said recess near said remote end being in a staggered, non-aligned form.

4. An electrical radiant heating panel as defined in claim 1 wherein said recess consists essentially of a single endless recess arranged as twin generally parallel serpentine recesses starting at one side of said board and progressing in serpentine form to the opposite side of said board, one of said twin recesses having a lateral portion nearer a first end of said board where the twin serpentine recesses are nearer said first end and the other of said twin recesses having a lateral portion nearer a remote end of said board where the twin serpentine recesses are nearer said remote end, said lateral portions nearer each respective end being in a staggered, non-aligned form relative to other lateral portions at said same respective end.

5. An electrical radiant heating panel as defined in claim 1 wherein said elongate parallel longitudinal portions are disposed in spaced parallel relationship in spaced increments of about two inches from one side edge to the opposite side edge of said board.

6. An electrical radiant heating panel as defined in claim 5 wherein said board has a length of from about six feet to twelve feet and said recesses are disposed in an area of from about two inches from one end to over halfway to the remote end.

7. An electrical radiant heating panel as defined in claim 6 wherein said recesses extend to about three-fourths of the distance to the remote end.

8. An electrical radiant heating panel as defined in claim 1 wherein said non-heating lead wire extends into said recess at a portion near the center of a lead-in end of said wallboard.

* * * * *